US005724783A

United States Patent [19]

Mandish

[11] Patent Number: 5,724,783

[45] Date of Patent: Mar. 10, 1998

[54] BUILDING PANEL APPARATUS AND METHOD

[76] Inventor: Theodore O. Mandish, 5055 State Rd. 46, Mims, Fla. 32754

[21] Appl. No.: 714,352

[22] Filed: Sep. 16, 1996

Related U.S. Application Data

[60] Continuation-in-part of Ser. No. 173,058, Dec. 27, 1993, Pat. No. 5,417,023, which is a division of Ser. No. 368,362, Jan. 4, 1995, Pat. No. 5,555,698.

[51] Int. Cl.[6] ..... E04B 2/56; E04C 2/20

[52] U.S. Cl. ..... 52/745.05; 52/DIG. 9; 52/144; 52/309.8; 52/309.13; 52/309.17; 52/404.3

[58] Field of Search ..... 52/DIG. 9, 309.13, 52/309.8, 309.17, 404.3, 144, 145, 794.1, 745.17, 745.05

[56] References Cited

U.S. PATENT DOCUMENTS

| | | | |
|---|---|---|---|
| 3,664,076 | 5/1972 | McCoy | 52/DIG. 9 X |
| 4,068,429 | 1/1978 | Moore | 52/DIG. 9 X |
| 4,653,243 | 3/1987 | Burkett | 52/309.8 X |
| 5,088,253 | 2/1992 | Christ | 52/DIG. 9 X |
| 5,272,284 | 12/1993 | Schmanski | 52/144 X |
| 5,367,844 | 11/1994 | Diedrich | 52/DIG. 9 X |
| 5,391,226 | 2/1995 | Frankowski | 52/DIG. 9 X |
| 5,417,023 | 5/1995 | Mandish | 52/348 |
| 5,425,207 | 6/1995 | Shayman | 52/309.8 X |
| 5,426,908 | 6/1995 | Shayman | 52/309.8 X |
| 5,555,698 | 9/1996 | Mandish | 52/348 X |

*Primary Examiner*—Wynn E. Wood
*Attorney, Agent, or Firm*—William M. Hobby, III

[57] ABSTRACT

A wall building panel apparatus includes a plurality of elongated panel frame members attached together to form a panel framework and having at least one stud attached between two panel frame members and having a panel side covering at least one side of the framework. A waste recycle aggregate material in a portland cement panel layer is formed in the panel to provide a prefabricated panel using waste recycle materials. A plurality of aggregate material and cement panel layers may be formed using recycled materials including used fiberglass insulation, recycled polystyrene, rubber tires, and old carpet material. The waste materials are converted to an aggregate through chopping, shredding, or with a hammer mill. A wall building process includes selecting waste recycling materials, such as used fiberglass insulation, used rubber tires, waste polystyrene, or waste carpet materials and converting the selected waste recycling materials into an aggregate material by chopping, shredding, or with a hammer mill. The aggregate is dampened and coated with a coating mixture which includes portland cement and microsilica. The coated aggregate recycling material is mixed with additional cement and sand and further mixed with additional cement and water and then placed into a building wall unit. The process includes placing the mixture in a plurality of layers with a wall panel, each layer including a different recycled material or combination of materials.

9 Claims, 2 Drawing Sheets

BUILDING PANEL APPARATUS AND METHOD

BACKGROUND OF THE INVENTION

The present invention relates to a wall building process and to a prefabricated wall panel and especially to a wall panel and process which utilizes recycled waste material for sound enhancement. This application is a continuation-in-part of my prior U.S. patent application Ser. No. 08/368,362, filed Jan. 4, 1995, now U.S. Pat. No. 5,555,698 which is a division of my prior U.S. patent application Ser. No. 08/173,058, filed Dec. 27, 1993 for a Building Panel Apparatus and Method, now U.S. Pat. No. 5,417,023.

It has become more important in recent years to find methods to dispose of large amounts of disposable waste material in a safe fashion and to recycle waste materials in a manner to prevent the filling of landfills. Special problems have arisen with the disposal of used rubber tires because of the large number of automobiles used throughout the world. The recycling of waste materials, such as used fiberglass insulation, can become a health hazard if not properly disposed. Another item frequently needing disposal is carpet made of polymer materials, such as worn carpet being removed from existing buildings when the building has the carpeting replaced or when the carpet is removed prior to the destruction of a building and carpet mill ends. Another commonly used product that needs recycling is polystyrene, which is a foamed polymer that is difficult to recycle and which is used widely in packaging products for shipping in a form commonly called "popcorn" and which is also widely used in disposable containers used in franchise restaurants. The present process is directed towards utilizing waste materials, such as used waste fiberglass, rubber tires, polystyrene of all types, and used carpet material, to produce a safe wall panel designed to condition a building for the handling of noise in a high noise area and to reduce noise contamination within a building area.

In my prior U.S. patent for a building panel apparatus and method, U.S. Pat. No. 5,417,023, a prefabricated panel is made of a plurality of elongated metal frame members attached together to form a panel framework and having a stud member attached between two of the panel frame members. These panels are designed for meeting the new hurricane standards within wall panels and in new construction and, at the same time, providing an insulated panel, which in some cases can support a lightweight concrete coating. The process of making the panel is illustrated in my prior U.S. Pat. No. 5,555,698 of Sep. 17, 1996. I have also suggested in the past, the use of chopped rubber tire pieces and polystyrene pieces incorporated into a portland cement and water mixture for the forming of an energy absorbing roadway barrier, as taught in my prior U.S. Pat. No. 5,286,136 of Feb. 15, 1994 and U.S. Pat. No. 5,292,467 of Mar. 8, 1994. Each of these patents is directed towards both the shape of the barrier and to an energy absorbing material and it includes an elongated core of reinforced high density concrete surrounded by a lightweight concrete using lightweight resilient polymer pieces, such as chopped of vulcanized rubber from chopped tires and from polystyrene with the addition of fiberglass, microsilica, sand, and portland cement, and water. The use of the chopped up rubber from the used tire which has been coated and incorporated into the cement produces a lightweight cement which acts as an energy absorbing cushion for a roadway barrier to cushion an automobile tire so as to help protect the occupants of the vehicle by the absorption of energy from the impact while preventing the vehicle from careening off a road or into an opposing lane of traffic. In my prior U.S. Pat. No. 4,011,355, for an emulsion coating for lightweight aggregate, I provide for a coated lightweight aggregate for mixing with cement, sand, and water for producing a lightweight construction material using expanded polystyrene beads coated with a mixture formed of dehydrated lime and hydra alumina with water in an amount to impart a suitable consistency in a wetting agent and the method of making the mixture and coating the bead to thereby allow the lightweight expanded polymer aggregates to be more evenly distributed with the cement and water mixture rather than floating to the surface and becoming concentrated on one side of the pour and to allow a better surfacing bond with the lightweight material.

The present invention is directed towards an improvement in my prior U.S. patents for a building panel, which improvement is directed towards a panel which utilizes waste recyclable materials within a building panel which are chosen to produce a sound barrier and sound conditioning wall in buildings, including residential and commercial buildings, or any wall area facing a noise area to isolate the noise area.

SUMMARY OF THE INVENTION

A wall building panel apparatus includes a plurality of elongated panel frame members attached together to form a panel framework and having at least one stud attached between two panel frame members and having a panel side covering at least one side of the framework. A waste recycle aggregate material in a portland cement panel layer is formed in the panel to provide a prefabricated panel using waste recycle materials. A plurality of aggregate material and cement panel layers may be formed using recycled materials including used fiberglass insulation, recycled polystyrene, rubber tires, and old carpet material. The waste materials are converted to an aggregate through chopping, shredding, or with a hammer mill. A wall building process includes selecting waste recycling materials, such as used fiberglass insulation, used rubber tires, waste polystyrene, or waste carpet materials and converting the selected waste recycling materials into an aggregate material by chopping, shredding, or with a hammer mill. The aggregate is dampened and coated with a coating mixture which includes portland cement and microsilica. The coated aggregate recycling material is mixed with additional cement and sand and further mixed with additional cement and water and then placed into a building wall unit. The process includes placing the mixture in a plurality of layers with a wall panel, each layer including a different recycled material or combination of materials.

BRIEF DESCRIPTION OF THE DRAWINGS

Other objects, features, and advantages of the present invention will be apparent from the Written description and the drawings in which.

DESCRIPTION OF THE PREFERRED EMBODIMENT

Figure 1:
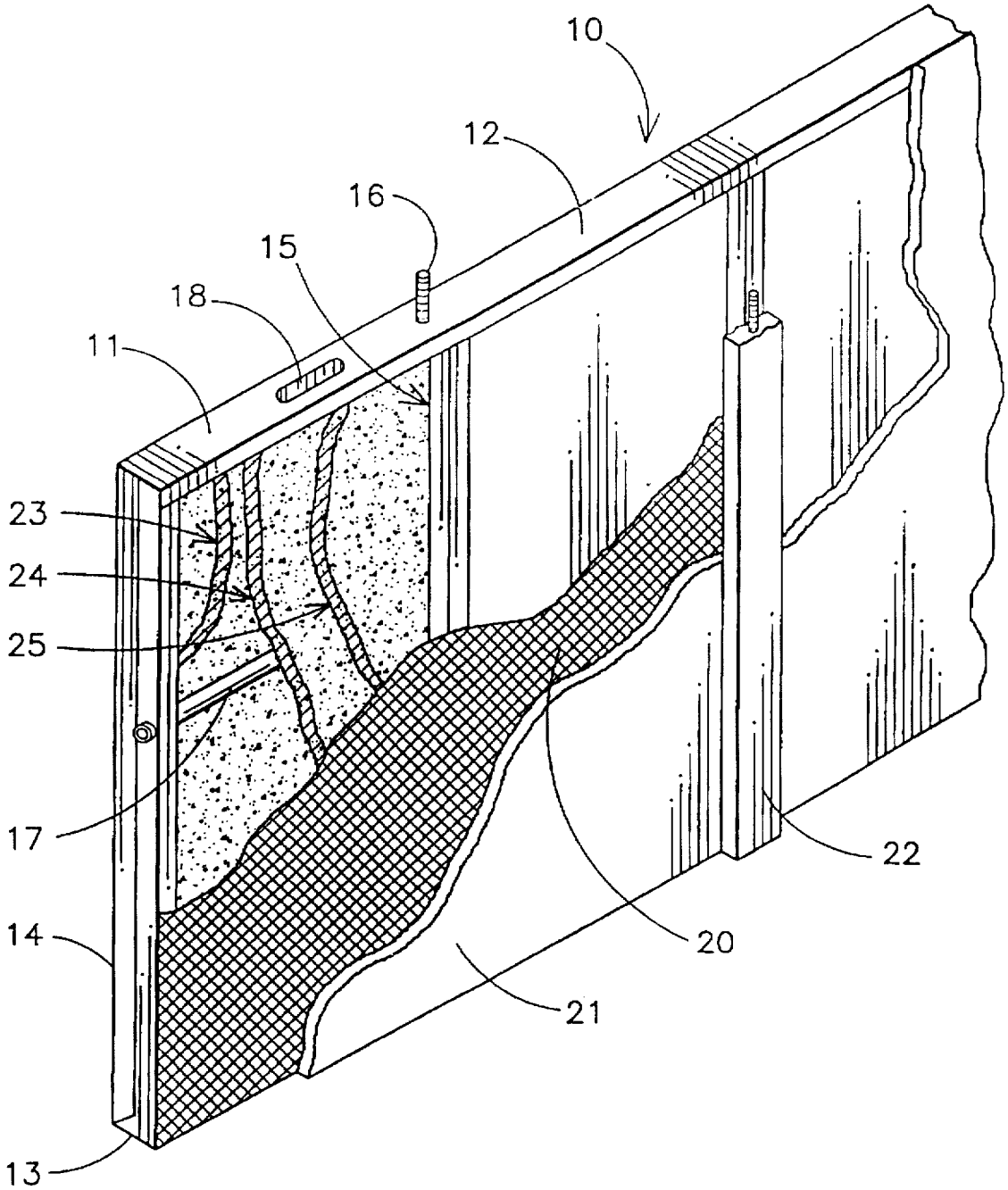
FIG. 1 is a cutaway perspective view of a wall panel in accordance with the present invention.

Referring to FIG. 1 of the drawings, a prefabricated building panel 10 is illustrated having a panel framework 11 including a top metal frame beam 12, a bottom frame member 13, and a pair of end frame members 14. The building panel 10 includes a central reinforcing metal stud 15. The building panel 10 includes a central reinforcing metal stud 15 having a thermal break therein mounted between frame members 12 and 13 which has a reinforcing metal bar or rebar 16 passing therethrough and extending through the frame member 12. The frame member 11 has a plurality of apertures or slots 18 therethrough. A piece of thin wall conduit 17 may pass between a pair of end frame members 14 for passing electrical lines therethrough. The panel may have one side thereof having a metal screen or mesh 20 thereover attached to the frame 11 and to the center stud member 15. The expanded metal mesh 23 may be attached with self-tapping screws to the metal frame members 14 and 12 and to the surface of the center stud 15 to provide additional strength to the overall panel to make the panel 10 act as a unit. The expanded metal mesh 20 may then be covered with a panel member 21 which can be of a metal or a wood product and may be a lightweight concrete applied thereover. A weather sealing strip 22 may be attached to one end of a panel for use in attaching pairs of panels to abutting ends, as shown in FIG. 1.

As shown in FIG. 1, the panel 10 is filled with a plurality of layers 23, 24, and 25 of portland cement and waste aggregate materials. The material in each of the layers 23, 24, and 25 includes a waste recycled aggregate material formed with a cement and sand mixture and cured in separate layers to form the individual layers 23, 24, and 25. The waste recycled aggregate material used with the portland cement mixture include waste rubber tires which have been chopped or cut to form the waste aggregate material or shredded used fiberglass, such as in used fiberglass insulation material, which has been shredded in a shredder and incorporated into the mixture. Waste materials also include polystyrene polymers which have been utilized for packaging, such as in popcorn package materials, and as used in restaurant chains and the like for insulated containers which containers have been shredded or chopped into an aggregate with a hammer mill or the like. Used carpet materials, such as those removed when replacing carpet in a building, or carpet ends are also used and are chopped and shredded into an aggregate composition. It is anticipated that each of the layers 23, 24, and 25 will include a different waste recycled aggregate material or a different combination of such materials. The materials have been coated with a cement and microsilica coating before being mixed with additional portland cement and sand prior to being mixed with additional portland cement, sand, and water and are placed in layers within the panel 10, each layer being cured prior to placing the next layer. The layer material of the portland cement composition with recycled aggregate material has the advantage of safely recycling waste materials that are difficult to recycle but, at the same time, provide a panel which is especially useful in both absorbing and blocking sound and can be utilized for walls to block off noisy areas and to sound condition the rooms of a building.

Figure 2:
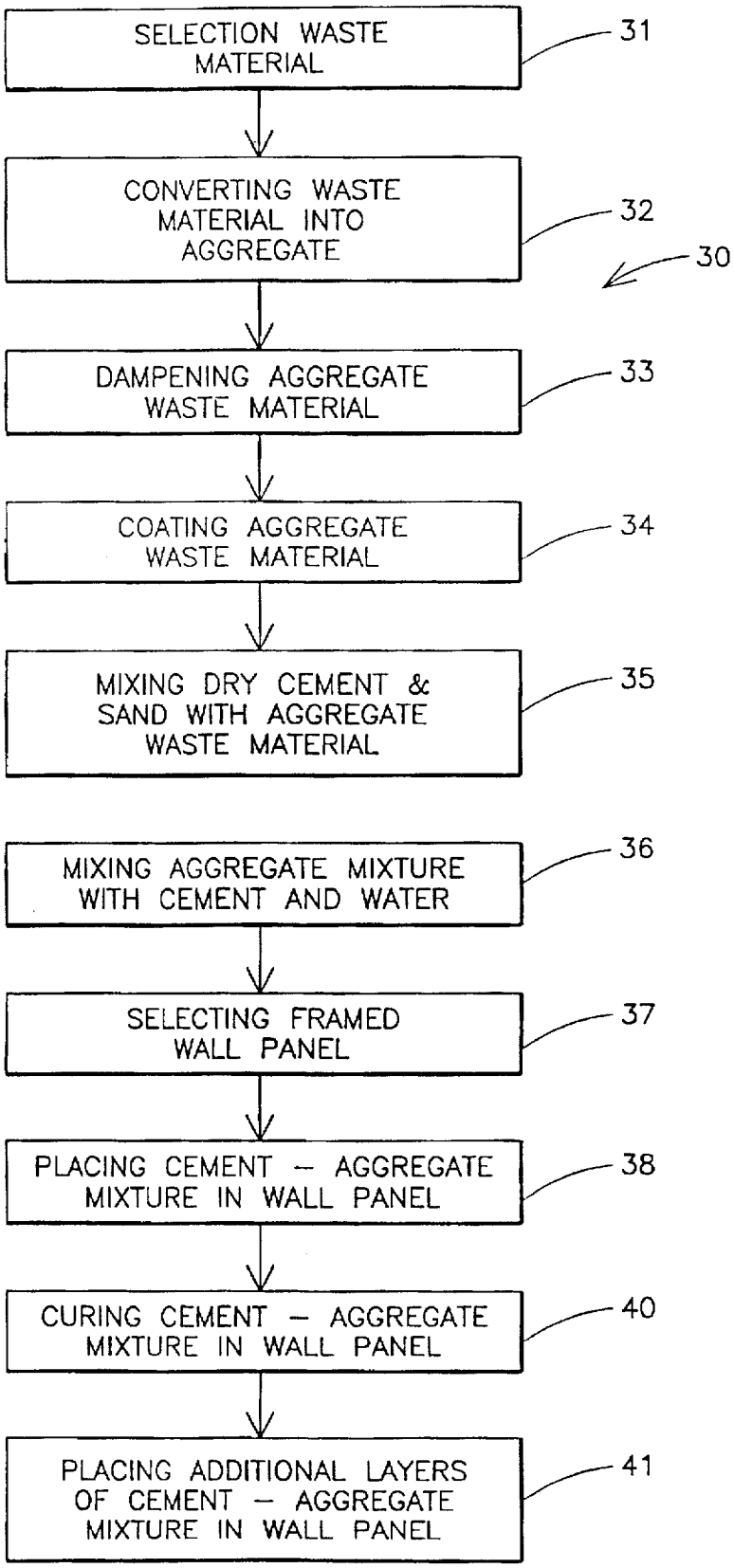
FIG. 2 is a flow diagram of a wall panel building process in accordance with the present invention.

Turning now to FIG. 2, a wall building process is illustrated in a flow diagram 30 which includes selecting a waste material (31) which includes selecting used and discarded rubber tires which have been cut or chopped into small aggregate pieces of waste material. Also included is shredded or chopped used and waste fiberglass materials, such as fiberglass insulation, and the use of waste polystyrene materials, such as packaging materials, including popcorn or specially formed blocks of polystyrene for supporting shipped items and shredded used or waste polystyrene containers. Waste carpet materials using synthetic fibers are also used, such as used carpets removed from buildings and mill ends. The selected materials are converted into an aggregate (32) which can be done with a hammer mill in some cases or a shredding machine in others while rubber tires require cutting or chopping of the material into smaller segments. Once the waste material is converted into an aggregate material, the aggregate material is dampened (33), which can be dampened with water in a mixer, the dampened aggregate material is then coated (34) with a microsilica and a portland cement and a surfactant so that the coating adheres to the slightly dampened aggregate material. The aggregate material then has dry cement and sand mixed (35) therewith as part of the drying process for drying the slightly dampened aggregate material and the addition of the portland cement and sand makes the material ready to be delivered to a mixer for mixing a final building panel layer. The mixed materials is mixed with an aggregate mixture with cement and water (36) which may also include additional sand and which may be mixed in a conventional cement mixer to prepare the cement aggregate mixture for placing in a selected framed wall panel (37) as in accordance with FIG. 1. The cement aggregate mixture is placed (38) within the wall panel in a first layer, which may include one or more of the waste aggregate materials mixed therein. The cement layer is cured (40) in the wall panel and additional layers are poured (41) in sequence within the building panel to form a plurality of layers, each of which may have a different recycled waste aggregate material or mixture of aggregate material. The final layered wall panel not only provides a great strength to the panel but, because of the portland cement, produces a wall having a resonance frequency so low that sound passing the prefabricated wall is of a low frequency below the hearing of a human ear and, in addition, noise or pressure waves impinging upon the wall having the aggregate recycled materials therein, is partially absorbed by the wall which conditions the sound within the isolated building area. In addition, the recycled material incorporated into the cement form a lightweight concrete which provides thermal insulation to the wall.

It should be clear at this time that a wall building process as well as a prefabricated wall panel have been provided which utilize a variety of waste recycling materials with special materials which are difficult to recycle to provide a sound and thermal insulating wall of great strength. However, the present invention should not be construed as limited to the forms disclosed herein.

I claim:

1. A wall building process comprising the steps of:

selecting a waste recycling material;

converting the selected waste recycling material into an aggregate material;

damping said waste recycling aggregate material with water;

coating said converted waste recycling material with a coating mixture including cement and microsilica;

mixing said coated aggregate recycling material in a cement and water mixture; and placing said mixed aggregate recycling material and cement and water mixture into a building wall unit and curing said cement to thereby create an improved wall structure.

2. A wall building process in accordance with claim 1 including the step of drying said coated converted recycling material.

3. A wall building process in accordance with claim 2 including the step of mixing said dried coated converted recycling material with additional cement and sand before mixing said coated aggregate recycling material with cement and water.

4. A wall building process in accordance with claim 1 in which said step of placing includes placing multiple layers of said aggregate recycling material in a wall unit each layer having a different waste recycling aggregate material therein.

5. A wall building process in accordance with claim 1 in which said step of selecting includes selecting a plurality of waste recycling materials.

6. A wall building process in accordance with claim 1 in which said step of selecting includes selecting waste fiberglass.

7. A wall building process in accordance with claim 1 in which said step of selecting includes selecting waste tires and cutting into a smaller aggregate.

8. A wall building process in accordance with claim 1 in which said step of selecting includes selecting waste polystyrene polymer and grinding.

9. A wall building process in accordance with claim 1 in which said step of selecting includes selecting waste carpet materials.

* * * * *